US008079238B2

(12) United States Patent
Lin

(10) Patent No.: US 8,079,238 B2
(45) Date of Patent: Dec. 20, 2011

(54) LOCK DEVICE

(75) Inventor: Ching Tien Lin, Taipei Hsien (TW)

(73) Assignee: Thase Enterprise Co., Ltd., Sinjhuang, Taipei Hsien (TW)

( * ) Notice: Subject to any disclaimer, the term of this patent is extended or adjusted under 35 U.S.C. 154(b) by 151 days.

(21) Appl. No.: 12/660,216

(22) Filed: Feb. 23, 2010

(65) Prior Publication Data

US 2011/0203326 A1 Aug. 25, 2011

(51) Int. Cl.
*E05B 13/00* (2006.01)

(52) U.S. Cl. ..... 70/107; 70/218; 70/222; 70/472; 292/169.22; 292/DIG. 27; 292/DIG. 61

(58) Field of Classification Search ..... 70/107, 70/149, 218, 222, 223, 277, 278.7, 283, 422, 70/472, DIG. 53, DIG. 54, DIG. 55; 292/169.14–169.17, 169.21–169.23, DIG. 27, 292/DIG. 61

See application file for complete search history.

(56) References Cited

U.S. PATENT DOCUMENTS

| | | | | |
|---|---|---|---|---|
| 3,042,437 | A | 7/1962 | Duvall | |
| 3,580,622 | A | 5/1971 | Morgan | |
| 4,429,556 | A * | 2/1984 | Kambic | 70/149 |
| 4,496,178 | A | 1/1985 | Best et al. | |
| 4,575,137 | A | 3/1986 | Jans | |
| 4,709,565 | A | 12/1987 | Lin | |
| 5,475,996 | A * | 12/1995 | Chen | 70/279.1 |
| 5,551,736 | A | 9/1996 | Fann et al. | |
| 5,640,863 | A * | 6/1997 | Frolov | 70/283 |
| 5,953,942 | A * | 9/1999 | Doucet et al. | 70/283 |
| 6,286,347 | B1 * | 9/2001 | Frolov | 70/472 |
| 6,354,121 | B1 * | 3/2002 | Frolov | 70/277 |
| 6,543,264 | B2 * | 4/2003 | Frolov | 70/222 |
| 6,581,423 | B2 * | 6/2003 | Lin | 70/107 |
| 6,619,705 | B2 * | 9/2003 | Dalsing | 292/169.14 |
| 6,622,535 | B2 * | 9/2003 | Chiang et al. | 70/107 |
| 7,698,918 | B2 * | 4/2010 | Geringer et al. | 70/278.7 |
| 2008/0011030 | A1 * | 1/2008 | Ferreira Sanchez et al. | 70/223 |

* cited by examiner

*Primary Examiner* — Lloyd Gall
(74) *Attorney, Agent, or Firm* — Charles E. Baxley

(57) ABSTRACT

A lock device includes an actuating lever pivotally engaged in a lock housing for actuating a deadbolt of a latch device, two rotary mechanisms pivotally engaged in the housing and each having a rotary member pivotally engaged in a casing for coupling to an outdoor handle and an indoor handle, and the rotary member of one of the rotary mechanisms is secured to the casing for allowing the rotary member and the casing of the rotary mechanism to be rotated relative to the lock housing with the indoor handle only, and for preventing the outdoor handle from being brutally rotated by the unauthorized persons and for preventing the lock device from being destroyed or damaged by the unauthorized persons.

9 Claims, 8 Drawing Sheets

LOCK DEVICE

BACKGROUND OF THE INVENTION

1. Field of the Invention

The present invention relates to a lock device, and more particularly to a lock device including an improved structure for selectively preventing the outdoor knob or handle from being forcedly or brutally rotated by the unauthorized persons and thus for preventing the lock device from being destroyed or damaged by the unauthorized persons.

2. Description of the Prior Art

Typical lock devices are normally attached to a door panel, and comprise a dead bolt extendible out of the lock casing for engaging with a door frame and for selectively locking the door panel to the door frame, and an indoor knob or handle and an outdoor knob or handle attached or coupled to the dead bolt of the lock device for rotating or operating the dead bolt to selectively lock and unlock the door panel.

For example, U.S. Pat. No. 3,042,437 to Duvall, U.S. Pat. No. 3,580,622 to Morgan, U.S. Pat. No. 4,496,178 to Best et al., U.S. Pat. No. 4,575,137 to Jans, U.S. Pat. No. 4,709,565 to Lin, and U.S. Pat. No. 5,551,736 to Fann et al. disclose several of the typical door lock devices each also comprising a lock casing secured to a door panel, and a dead bolt extendible out of the lock casing for engaging with a door frame, and an indoor knob or handle and an outdoor knob or handle attached or coupled to the dead bolt of the lock device for rotating or operating the dead bolt to selectively lock and unlock the door panel.

Normally, a spring biasing member is attached to the dead bolt or the handles or coupled between the handles and the lock casing for biasing or recovering the handles back to the original position and also for biasing or recovering the dead bolt to engage with the door frame after the handles are released by the user.

However, when the dead bolt is firmly or solidly locked and secured to the lock casing, the outdoor knob or handle may also be forcedly or brutally rotated by the unauthorized persons, and the inner structure of the typical door lock devices may also be destroyed or damaged by the unauthorized persons with the outdoor knob or handle.

The present invention has arisen to mitigate and/or obviate the afore-described disadvantages of the conventional lock devices for door panels.

SUMMARY OF THE INVENTION

The primary objective of the present invention is to provide a lock device including an improved structure for selectively preventing the outdoor knob or handle from being forcedly or brutally rotated by the unauthorized persons and thus for preventing the lock device from being destroyed or damaged by the unauthorized persons.

In accordance with one aspect of the invention, there is provided a lock device comprising a lock housing including a chamber formed therein, a latch device slidably received and engaged in the chamber of the lock housing and having a deadbolt extendible out of the lock housing, an actuating lever pivotally received and engaged in the chamber of the lock housing for engaging with the latch device and for selectively actuating the deadbolt of the latch device into the chamber of the lock housing, two rotary mechanisms pivotally received and engaged in the chamber of the lock housing and each including a casing and a cover secured together, and each including a compartment and a channel formed in the casing, and each including a rotary member pivotally received and engaged in the compartment of the casing, and each including a protrusion extended from the rotary member and slidably engaged with the channel of the casing for limiting the rotary member to rotate relative to the casings of the rotary mechanisms respectively, and each including a cavity formed in the rotary member, and each including an actuating finger extended outwardly from the casing for selectively engaging with the actuating lever, and each including a tongue slidably attached to the casing and each having an inner end extendible into the compartment of the casing for selectively engaging with the cavity of the rotary member and for selectively securing the rotary member and the casing together and for allowing the rotary member and the cover and the casing of each rotary mechanism to be rotated in concert with each other, an outdoor handle and an indoor handle coupled to the rotary members of the rotary mechanisms respectively for selectively rotating the rotary members of the rotary mechanisms relative to the lock housing respectively, two spring-biased followers received and engaged in the chamber of the lock housing and each including a limb for engaging with the protrusion of the rotary member and for allowing the rotary members to be selectively rotated relative to the lock housing with the spring-biased followers, and a fastener securing the tongue and the rotary member to the casing of a first of the rotary mechanisms for allowing the rotary member and the cover and the casing of the first rotary mechanism to be rotated relative to the lock housing with the indoor handle and for selectively preventing the outdoor knob or handle of the fire door from being forcedly or brutally rotated by the unauthorized persons and thus for preventing the lock device from being destroyed or damaged by the unauthorized persons.

The rotary mechanisms each include a spring biasing member engaged between the tongue and the casing for biasing and forcing and moving and disengaging the inner end of the tongue from the rotary member. The covers of the rotary mechanisms each include an opening formed therein for rotatably engaging with the rotary member.

The covers of the rotary mechanisms each include a slot formed therein and communicative with the opening of the cover, and the rotary members each include a projection extended outwardly therefrom and slidably engaged with the slot of the cover for limiting the rotary member to rotate relative to the casing and the cover.

The rotary members each include a cavity formed therein for selectively receiving and engaging with the tongue. The lock housing includes a rod extended in the chamber of the lock housing, and the followers are received and engaged in the chamber of the lock housing and pivotally attached to the rod of the lock housing, and each include two plates secured together with a stem and a spacer for forming a gap between the plates, the limb is extended from the spacer.

Two sliding members may further be provided and slidably engaged in the gaps between the plates of the followers respectively, and each include an oblong hole formed therein for engaging with the rod and for slidably anchoring and positioning the sliding members to the lock housing and for engaging with the stem, and two spring biasing members engaged with the sliding members for biasing the sliding members to engage with the stems of the followers respectively.

A seat may further be provided and disposed and received and engaged in the chamber of the lock housing and secured to the lock housing with at least one fastener, and engaged with the spring biasing members.

The lock housing includes a pole extended in the chamber of the lock housing, and the sliding members each include a passage formed therein for slidably engaging with the pole of the lock housing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
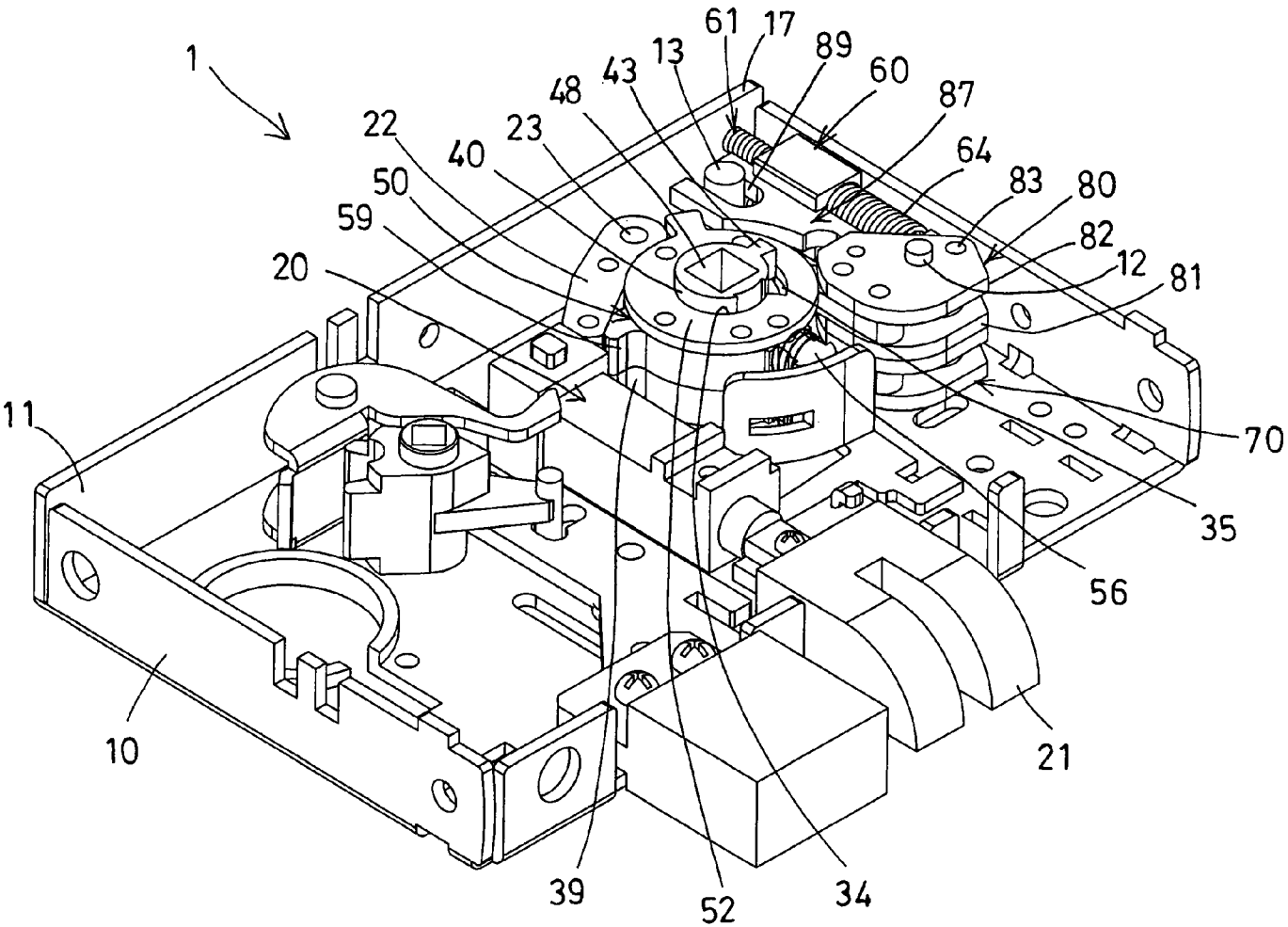
FIG. 1 is a partial perspective view of a lock device in accordance with the present invention, in which a portion of the lock device has been removed for showing the inner structure of the lock device.
Figure 2:
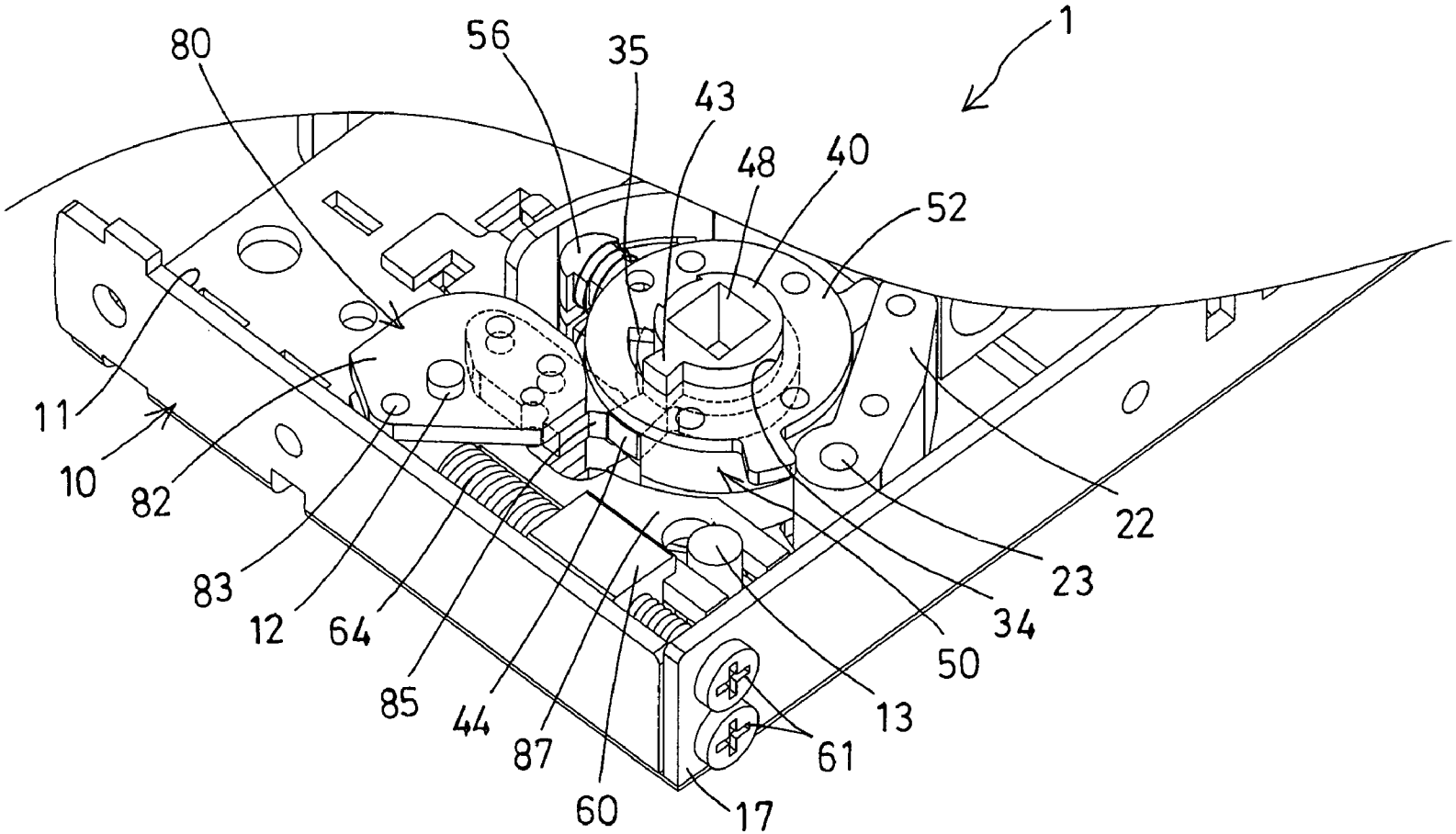
FIG. 2 is another partial perspective view as seen from the different or opposite angle of the lock device.
Figure 3:
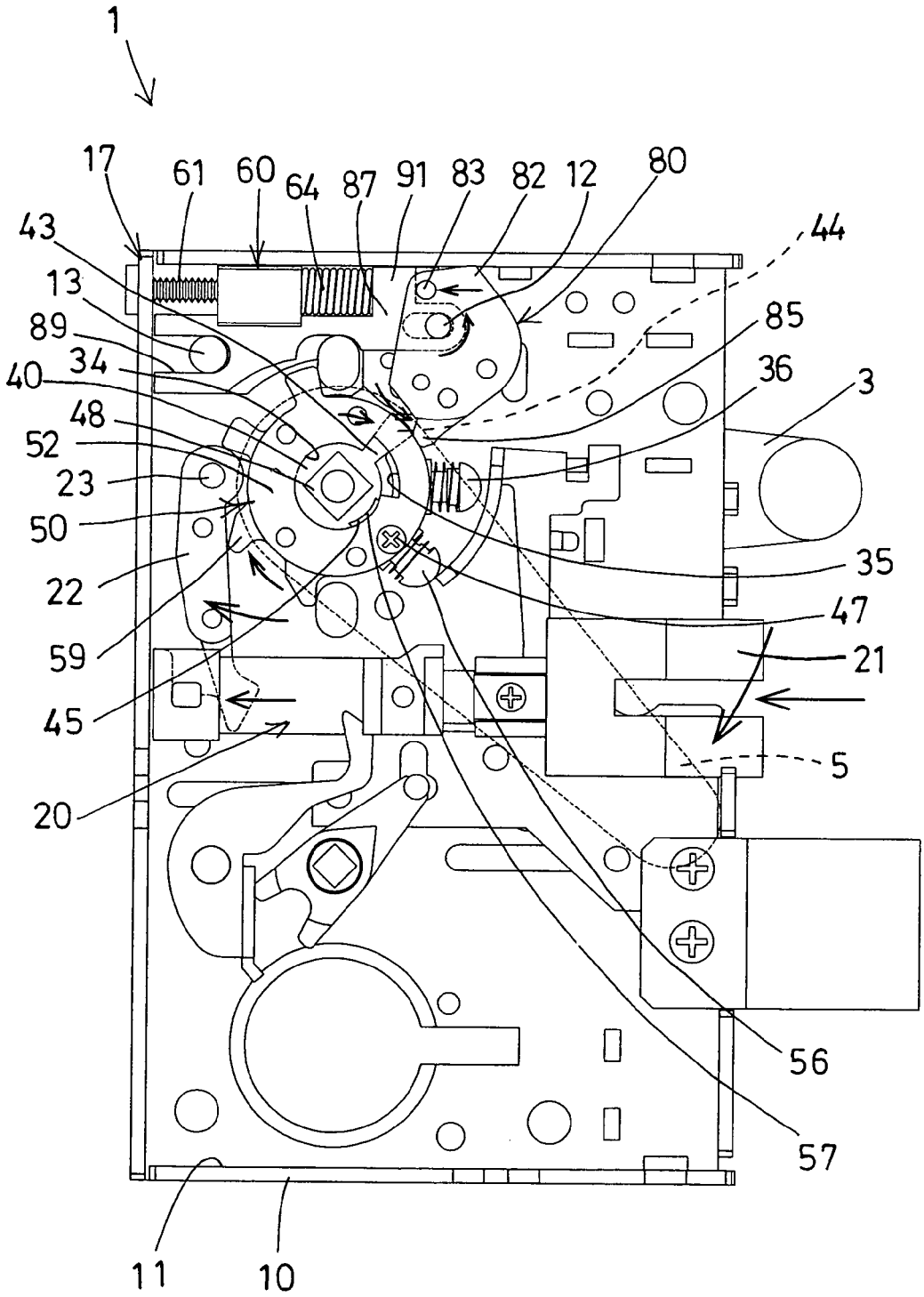
FIG. 3 is a top plan schematic view of the lock device, in which a portion of the lock device has also been removed for showing the inner structure of the lock device.
Figure 4:
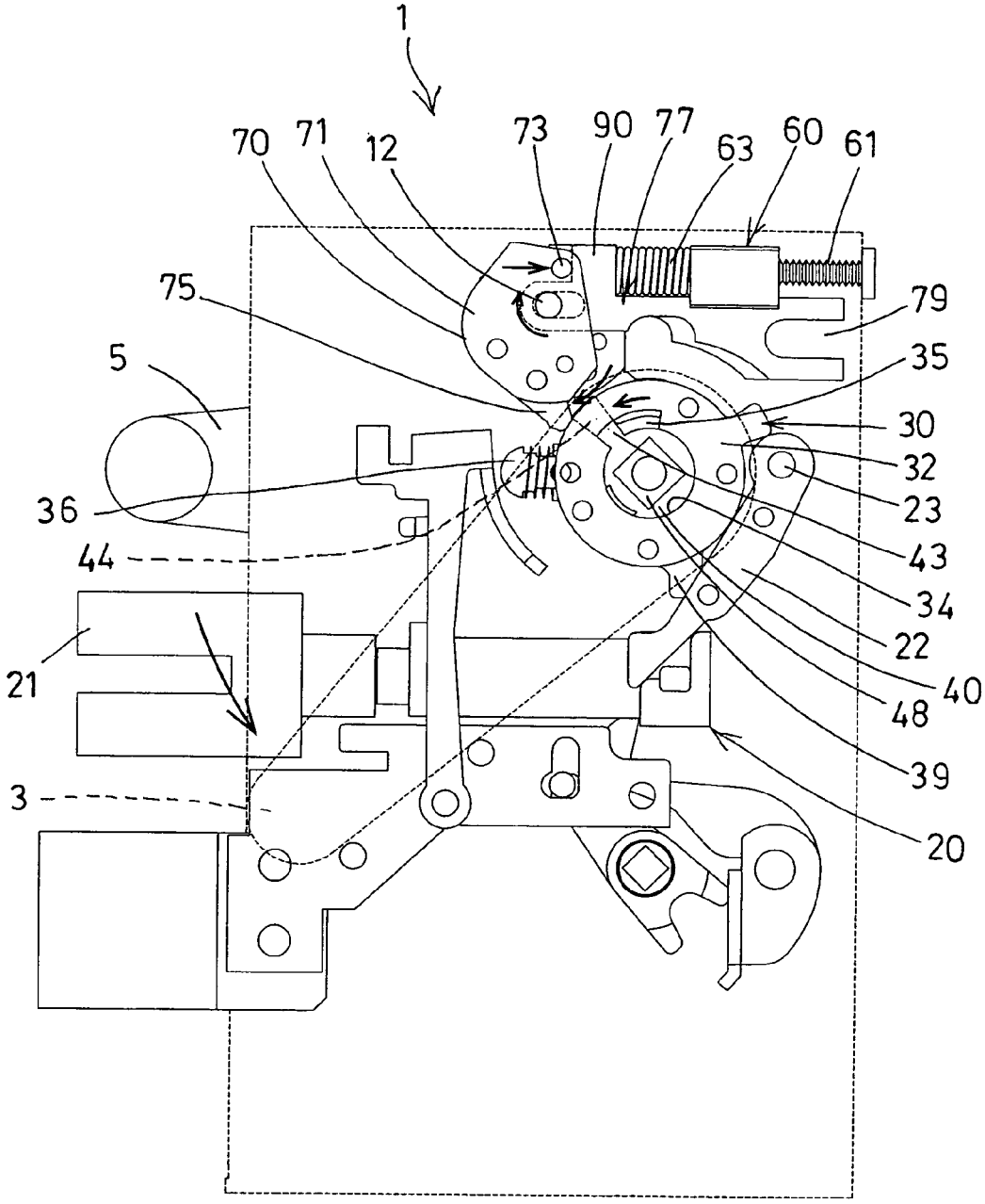
FIG. 4 is another top plan schematic view as seen from the different or opposite side of the lock device.
Figure 5:
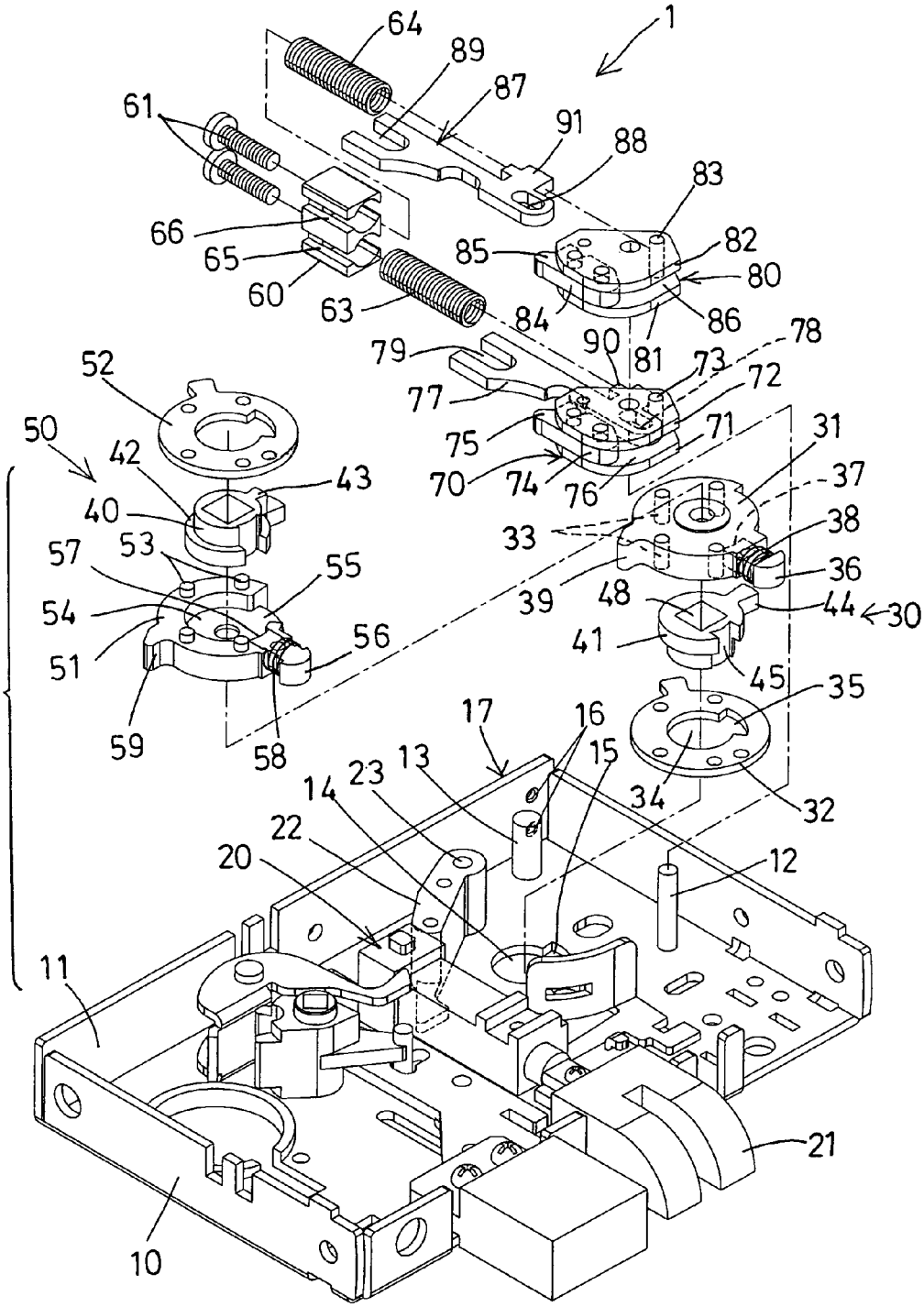
FIG. 5 is a partial exploded of the lock device.
Figure 6:
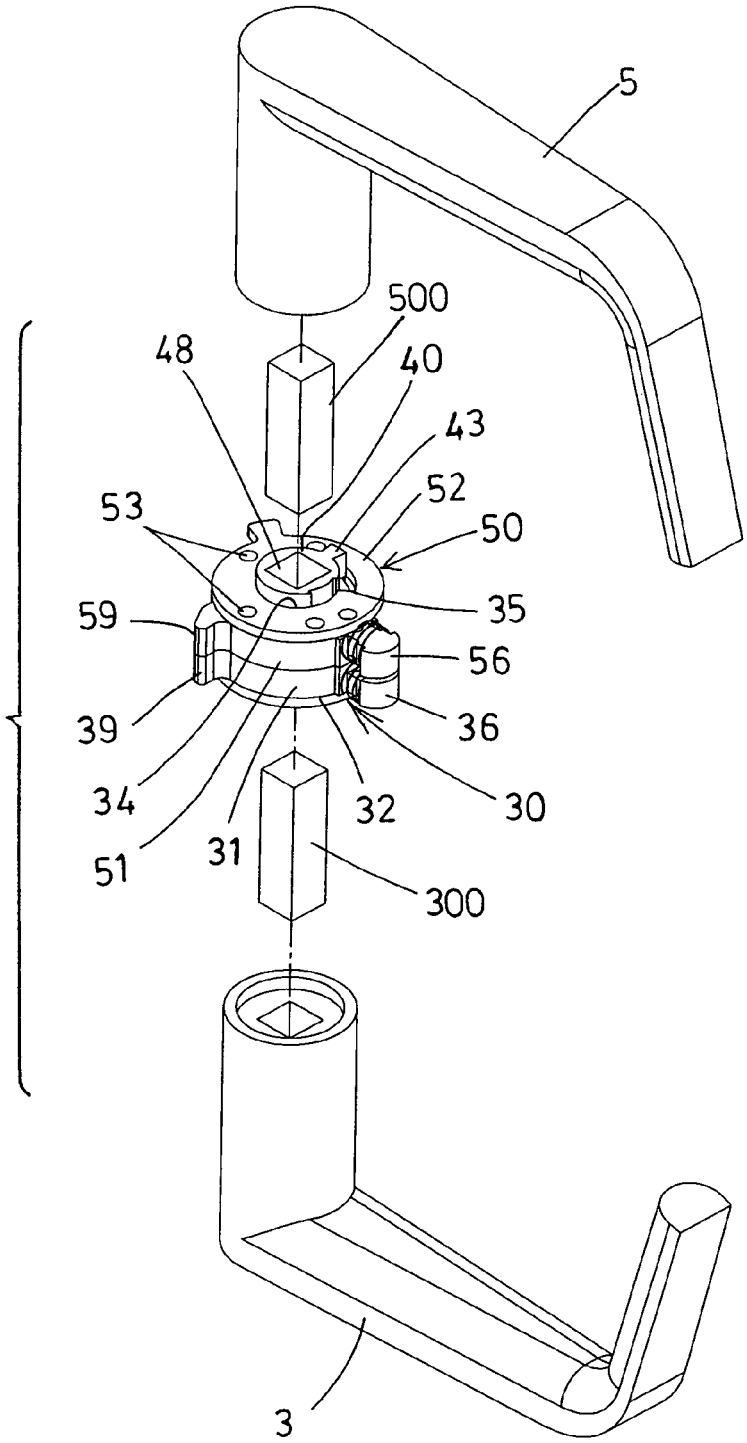
FIG. 6 is another partial exploded view of the lock device.

Referring to the drawings, and initially to FIGS. 1-5, a lock device 1 in accordance with the present invention comprises a lock housing 10 including a chamber 11 formed therein, and including a rod 12 and a pole 13 formed or provided or extended in the chamber 11 of the lock housing 10, and including an orifice 14 and a notch 15 formed therein and communicative with each other and also communicative with the chamber 11 of the lock housing 10, and including one or more (such as two) apertures 16 formed in one side wall 17 of the lock housing 10, and including a latch device 20 slidably received or engaged in the chamber 11 of the lock housing 10 and having a deadbolt 21 extended or extendible out of the lock housing 10 (FIGS. 1, 4).

An actuating lever 22 is further provided and pivotally or rotatably received or engaged in the chamber 11 of the lock housing 10 with a pivot axle 23 for selectively engaging with the latch device 20 (FIGS. 1, 3-4) and for selectively actuating or moving the deadbolt 21 of the latch device 20 into the chamber 11 of the lock housing 10 (FIG. 3), or for allowing the deadbolt 21 of the latch device 20 to be selectively extended out of the lock housing 10 (FIGS. 1, 4). As shown in FIGS. 1 and 5-7, two rotary mechanisms 30, 50 are also pivotally or rotatably received or engaged in the chamber 11 of the lock housing 10 for coupling to an outdoor knob or handle 3 and an indoor knob or handle 5 respectively (FIGS. 3, 4, 6) and for being pivoted or rotated relative to the lock housing 10 with the handles 3, 5 to actuate or operate the actuating lever 22 and the latch device 20.

For example, the rotary mechanisms 30, 50 each include a hub or casing 31, 51 and a cover 32, 52 attached or secured to the upper portion or one side of the casing 31, 51 with locks or fasteners or catches 33, 53, and each include a compartment 54 and a channel 55 formed therein (FIG. 5), such as formed in the casing 31, 51 and communicative with each other, in which the casings 31, 51 and the covers 32, 52 of the rotary mechanisms 30, 50 include the same or identical structure. The rotary mechanisms 30, 50 each further include an opening 34 and a slot 35 formed in the covers 32, 52 and communicative with each other and aligned with or communicative with the compartment 54 and the channel 55 of the casing 31, 51 respectively, in which the openings 34 of the covers 32, 52 include a size or dimension or area slightly smaller than that of the compartments 54 of the casings 31, 51 respectively.

A tongue 36, 56 is slidably received or engaged or attached or mounted to each of the casings 31, 51 of the rotary mechanisms 30, 50 respectively, and each include an inner end 37, 57 selectively extendible into the compartment 54 of the casing 31, 51 respectively, and each include a spring biasing member 38, 58 attached or mounted onto the tongue 36, 56 respectively and engaged with or between the tongue 36, 56 and the casing 31, 51 respectively for biasing or forcing or moving the inner end 37, 57 of the tongue 36, 56 out of the compartment 54 of the casing 31, 51 respectively. The rotary mechanisms 30, 50 each further include an extension or actuating finger 39, 59 extended outwardly from the casing 31, 51 for selectively engaging with the actuating lever 22 and the latch device 20 (FIGS. 1, and 3-4).

The rotary mechanisms 30, 50 each further include a rotary member 40 pivotally or rotatably received and engaged in the opening 34 of the cover 32, 52 and/or the compartment 54 of the casing 31, 51, and each include a protruded or peripheral bulge 41 extended radially and outwardly from the rotary member 40 and pivotally or rotatably received and engaged in the compartment 54 of the casing 31, 51 respectively, and having an outer diameter or dimension greater than that of the rotary member 40 for forming a peripheral shoulder 42 therein and for engaging with the cover 32, 52, and for stably anchoring and retaining the rotary member 40 to the casings 31, 51 and the covers 32, 52 of the rotary mechanisms 30, 50 respectively.

The rotary member 40 each include a projection 43 and a protrusion 44 extended outwardly therefrom and slidably engaged with or engaged in the slot 35 of the cover 32, 52 and the channel 55 of the casing 31, 51 respectively for limiting the rotary members 40 to rotate relative to the casings 31, 51 and the covers 32, 52 of the rotary mechanisms 30, 50 respectively, and the rotary member 40 each further include a cavity 45 formed therein for selectively receiving or engaging with the inner end 37, 57 of the tongue 36, 56 respectively (FIG. 3) and for selectively and solidly anchoring or securing and retaining the tongue 36, 56 to the covers 32, 52 and the casings 31, 51 of the rotary mechanisms 30, 50 respectively, when required. The spring biasing members 38, 58 may bias and disengage the tongue 36, 56 from the rotary member 40.

For example, as shown in FIG. 3, a latch or catch or fastener 47 may be selectively engaged with the covers 32, 52 of either of the rotary mechanisms 30, 50 and engaged with either of the tongues 36, 56 for selectively securing and retaining the tongue 36, 56 to the cover 32, 52 of the respective rotary mechanisms 30, 50 and for selectively securing and retaining the inner end 37, 57 of the tongue 36, 56 in engagement with the cavity 45 of the rotary member 40 respectively, and thus for selectively securing and coupling the rotary member 40 to the covers 32, 52 and the casings 31, 51 of the rotary mechanisms 30, 50 respectively, and thus for allowing the rotary member 40 and the covers 32, 52 and the casings 31, 51 of the rotary mechanisms 30, 50 to be rotated in concert with each other selectively.

Figure 7:
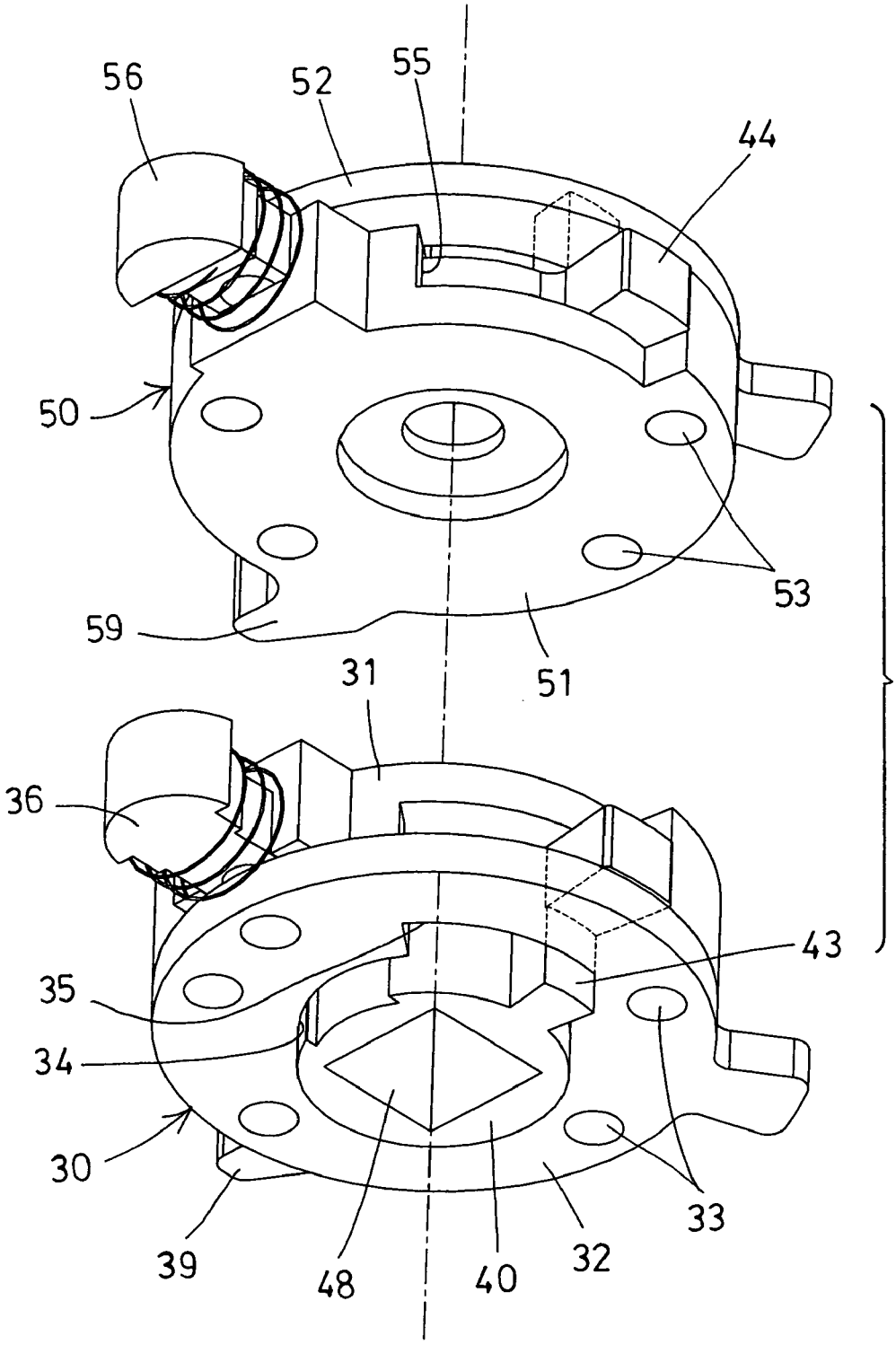
FIG. 7 is a further partial exploded view of the lock device.
Figure 8:
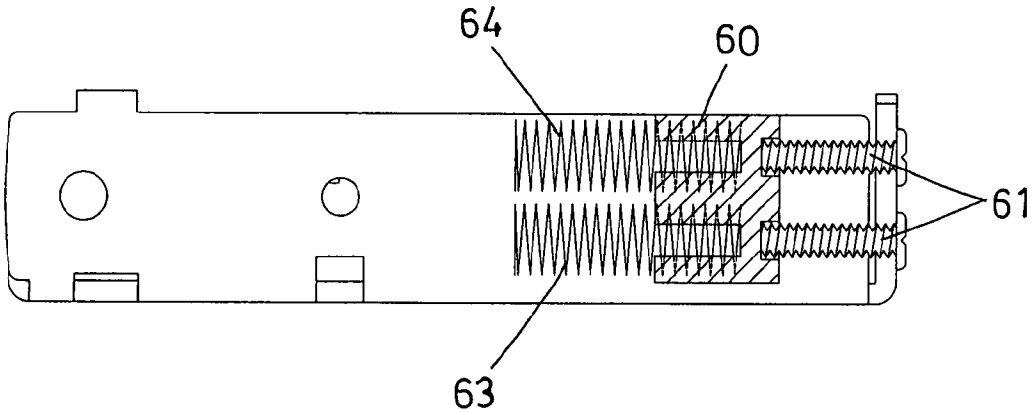
FIG. 8 is a partial cross sectional view of the lock device.

As shown in FIGS. 1-2 and 7, the rotary member 40 is extended out of the cover 32, 52 of the respective rotary mechanisms 30, 50 for selectively engaging with the orifice 14 of the lock housing 10 (FIG. 5) and for stably or solidly anchoring or retaining the rotary member 40 to the covers 32, 52 and the casings 31, 51 of the rotary mechanisms 30, 50 respectively. The rotary member 40 each include an engaging hole 48 formed therein, particularly a non-circular or square engaging hole 48 formed therein for engaging with a corresponding non-circular driving shank 300, 500 which includes a square cross section for engaging with the handles 3, 5 and for coupling the handles 3, 5 to the rotary members 40 and for allowing the rotary members 40 of the rotary mechanisms 30, 50 to be selectively pivoted or rotated or driven relative to the lock housing 10 with the handles 3, 5 respectively.

In operation, as shown in FIG. 3, the fastener 47 may be selectively engaged with the cover 52 of one of the rotary mechanisms 50 and engaged with the tongue 56 for selectively securing and retaining the tongue 56 to the cover 52 of the rotary mechanism 50 and for selectively securing and retaining the inner end 57 of the tongue 56 in engagement with the cavity 45 of the rotary member 40, and thus for securing and coupling the rotary member 40 to the cover 52 and the casing 51 of the rotary mechanism 50, and thus for allowing the rotary member 40 and the cover 52 and the casing 51 of the rotary mechanism 50 to be rotated in concert with each other selectively, and thus for allowing the rotary member 40 and the cover 52 and the casing 51 of the rotary mechanism 50 to be rotated or driven relative to the lock housing 10 with the indoor handle 5.

When the cover 52 and the casing 51 of the rotary mechanism 50 may be rotated or driven relative to the lock housing 10 with the rotary member 40 and the indoor handle 5, the actuating finger 59 of the rotary mechanism 50 may be rotated or forced to selectively engage with the actuating lever 22 and the latch device 20, in order to selectively actuate or move the deadbolt 21 of the latch device 20 into the chamber 11 of the lock housing 10 (FIG. 3), or out of the lock housing 10 (FIGS. 1, 4). Accordingly, the deadbolt 21 of the latch device 20 may be selectively forced or actuated or operated with the indoor handle 5 to either engage into or out of the chamber 11 of the lock housing 10.

On the contrary, as shown in FIG. 4, the tongue 36 has not been engaged or attached or mounted to the cover 32 and the casing 31 of the rotary mechanism 30, and the inner end 57 of the tongue 56 is not in engagement with the cavity 45 of the rotary member 40, such that the rotary member 40 has not been coupled or secured to the cover 32 and the casing 31 of the rotary mechanism 30, and such that the cover 32 and the casing 31 of the rotary mechanism 30 may not be rotated or driven relative to the lock housing 10 with the outdoor handle 3, and such that the inner structure of the door lock device 1 may not be destroyed or damaged by the unauthorized persons with the outdoor knob or handle 3.

Figure 9:
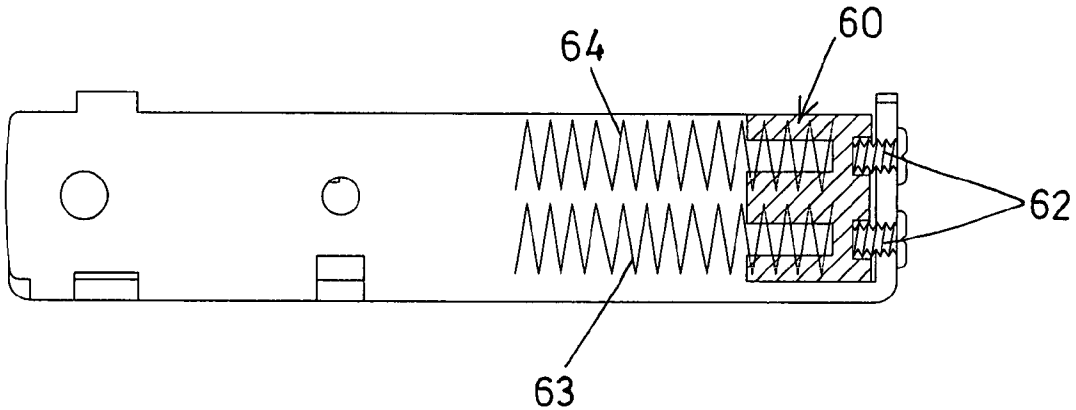
FIG. 9 is another partial cross sectional view similar to FIG. 8, illustrating the operation of the lock device.

As shown in FIGS. 1-5 and 8, the door lock device 1 may further include a seat 60 disposed and received or engaged in the chamber 11 of the lock housing 10 and attached or secured to the lock housing 10, such as secured to the side wall 17 of the lock housing 10 with one or more (such as two) latches or locks or fasteners 61 (FIG. 8) or 62 (FIG. 9), in which the fasteners 61 or 62 may include different lengths for securing and retaining the seat 60 at different or required positions, and two further spring biasing members 63, 64 attached or mounted onto or engaged with the seat 60, and the seat 60 further include two grooves 65, 66 formed therein.

Two spring-biased followers 70, 80 are disposed and received or engaged in the chamber 11 of the lock housing 10 and pivotally or rotatably attached or coupled to the rod 12 of the lock housing 10, and each include two plates 71, 72; 81, 82 disposed parallel to each other and secured together with a stem 73, 83 and a spacer 74, 84 for forming or defining a space or gap 76, 86 between the plates 71, 72; 81, 82 respectively, in which the spacer 74, 84 includes a protrusion or limb 75, 85 extended outwardly therefrom and extended out of the followers 70, 80 for engaging with the protrusions 44 of the rotary members 40 respectively (FIGS. 3, 4), and two bars or sliding members 77, 87 are slidably received or engaged in the gap 76, 86 between the plates 71, 72; 81, 82 of the followers 70, 80 respectively and slidably engaged with the grooves 65, 66 of the seat 60, and each include an oblong hole 78, 88 formed therein for receiving or engaging with the rod 12 and for slidably anchoring or positioning the bars or sliding members 77, 87 to the lock housing 10.

The bars or sliding members 77, 87 each further include a passage 79, 89 formed therein for slidably receiving or engaging with the pole 13 of the lock housing 10 and for further slidably anchoring or positioning the sliding members 77, 87 to the lock housing 10 and for limiting the bars or sliding members 77, 87 to slide relative to the lock housing 10, and each further include an extension 90, 91 extended outwardly therefrom for engaging with the stem 73, 83 and the spring biasing members 63, 64 (FIGS. 3, 4) and for allowing the bars or sliding members 77, 87 to be moved onto or against the spring biasing members 63, 64 by the stem 73, 83 of the follower 70, 80 when the follower 70, 80 is rotated relative to the rod 12 of the lock housing 10, and/or for allowing the spring biasing members 63, 64 to apply a spring biasing force to bias the sliding member 77, 87 to engage with the stem 73, 83, or to recover the sliding member 77, 87 and the follower 70, 80 back to the original position.

In operation, as shown in FIG. 3, the fastener 47 may selectively secure the tongue 56 to the cover 52 of the rotary mechanism 50 and may secure the inner end 57 of the tongue 56 in engagement with the cavity 45 of the rotary member 40 for allowing the rotary member 40 and the cover 52 and the casing 51 of the rotary mechanism 50 to be rotated or driven relative to the lock housing 10 with the indoor handle 5. When the rotary mechanism 50 is rotated relative to the lock housing 10, the actuating finger 59 of the rotary mechanism 50 may be engaged with the actuating lever 22 to selectively actuate or move the deadbolt 21 of the latch device 20 into the chamber 11 of the lock housing 10. At this moment, the protrusion 44 of the rotary member 40 may be engaged with the limb 85 of the spacer 84 of the follower 80 to rotate the follower 80 around the rod 12 and to force the stem 83 to force or move the extension 91 onto or against the spring biasing member 64.

When the indoor handle 5 is released, the spring biasing member 64 may bias or force or move the extension 91 onto or against the stem 83 of the follower 80 in order to rotate the follower 80 around the rod 12 and to force the limb 85 of the spacer 84 of the follower 80 to engage with the protrusion 44 of the rotary member 40 and to rotate the rotary member 40 and the cover 52 and the casing 51 of the rotary mechanism 50 back to the original position. On the contrary, as shown in FIG. 4, the tongue 36 has not been mounted to the cover 32 of the rotary mechanism 30 such that the rotary member 40 has not been secured to the cover 32 of the rotary mechanism 30, and such that the cover 32 and the casing 31 of the rotary mechanism 30 may not be rotated or driven relative to the lock housing 10 with the outdoor handle 3, and such that the inner structure of the door lock device 1 may not be destroyed or damaged by the unauthorized persons with the outdoor knob or handle 3.

It is to be noted that the door lock device 1 may be attached to a door panel (not shown) as a fire door mechanism, for allowing the door lock device 1 to be operated with the indoor handle 5 only, and for preventing the door lock device 1 from being operated or actuated by the outdoor handle 3 or from outside of the buildings or housings. It is further to be noted that the tongue 36 also be mounted to the cover 32 of the rotary mechanism 30 for allowing the rotary member 40 and the cover 32 and the casing 31 of the rotary mechanism 30 to be rotated or driven relative to the lock housing 10 with the outdoor handle 3 when required. The fasteners 61 or 62 and the seat 60 may be used to adjust the spring biasing force of the spring biasing members 63, 64 onto the followers 70, 80 respectively.

Accordingly, the lock device in accordance with the present invention includes an improved structure for selectively preventing the outdoor knob or handle of the fire door from being forcedly or brutally rotated by the unauthorized persons and thus for preventing the lock device from being destroyed or damaged by the unauthorized persons.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A lock device comprising:

a lock housing including a chamber formed therein, a latch device slidably received and engaged in said chamber of said lock housing and having a deadbolt extendible out of said lock housing, an actuating lever pivotally received and engaged in said chamber of said lock housing for engaging with said latch device and for selectively actuating said deadbolt of said latch device into said chamber of said lock housing, two rotary mechanisms pivotally received and engaged in said chamber of said lock housing and each including a casing and a cover secured together, and each including a compartment and a channel formed in said casing, and each including a rotary member pivotally received and engaged in said compartment of said casing, and each including a protrusion extended from said rotary member and slidably engaged with said channel of said casing for limiting said rotary member to rotate relative to said casings of said rotary mechanisms respectively, and each including a cavity formed in said rotary member, and each including an actuating finger extended outwardly from said casing for selectively engaging with said actuating lever, and each including a tongue slidably attached to said casing and each having an inner end extendible into said compartment of said casing for selectively engaging with said cavity of said rotary member and for selectively securing said rotary member and said casing together and for allowing said rotary member and said cover and said casing of each rotary mechanism to be rotated in concert with each other, an outdoor handle and an indoor handle coupled to said rotary members of said rotary mechanisms respectively for selectively rotating said rotary members of said rotary mechanisms relative to said lock housing respectively, two spring-biased followers received and engaged in said chamber of said lock housing and each including a limb for engaging with said protrusion of said rotary member and for allowing said rotary members to be selectively rotated relative to said lock housing with said spring-biased followers, and a fastener securing said tongue and said rotary member to said casing of a first of said rotary mechanisms for allowing said rotary member and said cover and said casing of said first rotary mechanism to be rotated relative to said lock housing with said indoor handle.

2. The lock device as claimed in claim 1, wherein said rotary mechanisms each include a spring biasing member engaged between said tongue and said casing for biasing and forcing and moving and disengaging said inner end of said tongue from said rotary member.

3. The lock device as claimed in claim 1, wherein said covers of said rotary mechanisms each include an opening formed therein for engaging with said rotary member.

4. The lock device as claimed in claim 3, wherein said covers of said rotary mechanisms each include a slot formed therein and communicative with said opening of said cover, and said rotary members each include a projection extended outwardly therefrom and slidably engaged with said slot of said cover for limiting said rotary member to rotate relative to said casing and said cover.

5. The lock device as claimed in claim 1, wherein said rotary members each include a cavity formed therein for selectively receiving and engaging with said tongue.

6. The lock device as claimed in claim 1, wherein said lock housing includes a rod extended in said chamber of said lock housing, and said followers are received and engaged in said chamber of said lock housing and pivotally attached to said rod of said lock housing, and each include two plates secured together with a stem and a spacer for forming a gap between said plates, said limb is extended from said spacer.

7. The lock device as claimed in claim 6, wherein two sliding members are slidably engaged in said gaps between said plates of said followers respectively, and each include an oblong hole formed therein for engaging with said rod and for slidably anchoring and positioning said sliding members to said lock housing and for engaging with said stem, and two spring biasing members engaged with said sliding members for biasing said sliding members to engage with said stems of said followers respectively.

8. The lock device as claimed in claim 7, wherein a seat is disposed and received and engaged in said chamber of said lock housing and secured to said lock housing with at least one fastener, and engaged with said spring biasing members.

9. The lock device as claimed in claim 7, wherein said lock housing includes a pole extended in said chamber of said lock housing, and said sliding members each include a passage formed therein for slidably engaging with said pole of said lock housing.

* * * * *